United States Patent [19]

Kuo

[11] Patent Number: 4,989,857

[45] Date of Patent: Feb. 5, 1991

[54] STAIRCLIMBER WITH A SAFETY SPEED CHANGING DEVICE

[76] Inventor: Hai-Pin Kuo, Chi-Lu-Chien No. 30, Pao-An-Tsun, Jen-Ten Hsian, Tainan County, Taiwan

[21] Appl. No.: 536,986

[22] Filed: Jun. 12, 1990

[51] Int. Cl.[5] ..... A63B 1/00; A63B 22/02

[52] U.S. Cl. ..... 272/70; 272/69; 272/DIG. 4

[58] Field of Search ..... 272/69, 70, 72, 129, 272/73, 96, 97, 134, DIG. 4; 128/25 R

[56] References Cited

U.S. PATENT DOCUMENTS

| | | | |
|---|---|---|---|
| 2,969,768 | 1/1969 | Grant | 272/69 |
| 4,687,195 | 8/1987 | Potts | 272/69 |
| 4,708,338 | 11/1987 | Potts | 272/129 |
| 4,726,581 | 2/1988 | Chang | 272/70 |

*Primary Examiner*—Stephen R. Crow

*Attorney, Agent, or Firm*—Morton J. Rosenberg; David I. Klein

[57] ABSTRACT

This invention relates to a stairclimber with a safety speed changing device and in particular to one including a base, a handle frame vertically mounted on the base, a support vertically mounted between a gauge board and the base, a front bracket fixed on the base and spaced apart from the support, a rear bracket mounted on the base and disposed rearwardly of the front bracket, a transmission mechanism fixedly mounted on upper side of the front bracket and provided with a pulley connected to a rotating disc of a motor via a belt and a link pivotally connected with an oscillating rod having a pair of pedals, and a speed changing mechanism having a rotating handle disposed on upper half of the support to control an upper gear which in turn drives a lower gear via a chain.

1 Claim, 4 Drawing Sheets

STAIRCLIMBER WITH A SAFETY SPEED CHANGING DEVICE

BACKGROUND OF THE INVENTION

This invention relates to a stairclimber with a safety speed changing device.

While the type and extent of the exercise individuals practice often depends on a physician's recommendations, it is recognized that exercise should not only be regular but also sufficiently strenuous to cause the heart beat to be accelerated for a reasonable but substantial interval.

Hence, a stairclimbing exerciser has been developed to meet the need, which utilizes the vertical movement of two pedals to pull two corresponding hydraulic cylinders to simulate the stairclimbing motion. However, when the pedals is pressed downwards, the string wrapped around the pulley is subjected to the tension produced by the movement of the pedals and may be broken during operation thereby easily causing accident to the user.

It is, therefore, an object of the present invention to provide a stairclimber which may obviate and mitigate the above-mentioned drawbacks.

SUMMARY OF THE INVENTION

This invention relates to a stairclimber with a safety speed changing device.

It is the primary object of the invention to provide a stairclimber which may effectively exercise the legs of a user.

It is another object of the present invention to provide a stairclimber which is safe in use.

It is still another object of the present invention to provide a stairclimber which is sturdy in construction.

It is still another object of the present invention to provide a stairclimber which is easy to operate.

Other objects and merits and a fuller understanding of the present invention will be obtained by those having ordinary skill in the art when the following detailed description of the preferred embodiment is read in conjunction with the accompanying drawings.

DETAILED DESCRIPTION OF THE PREFERRED EMBODIMENT

Figure 1:
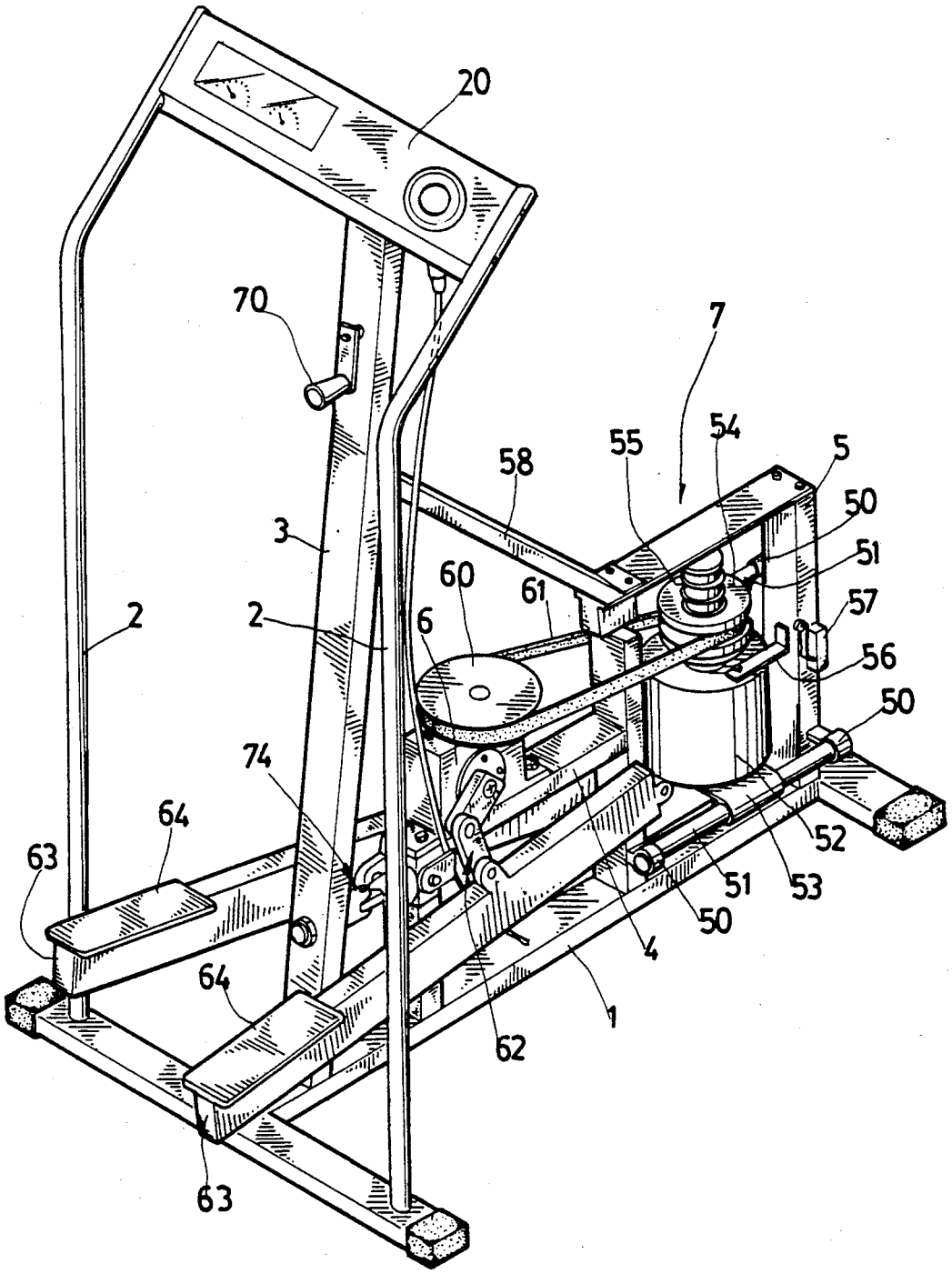
FIG. 1 is a perspective view of a stairclimber with a safety speed changing device according to the present invention.
Figure 2:
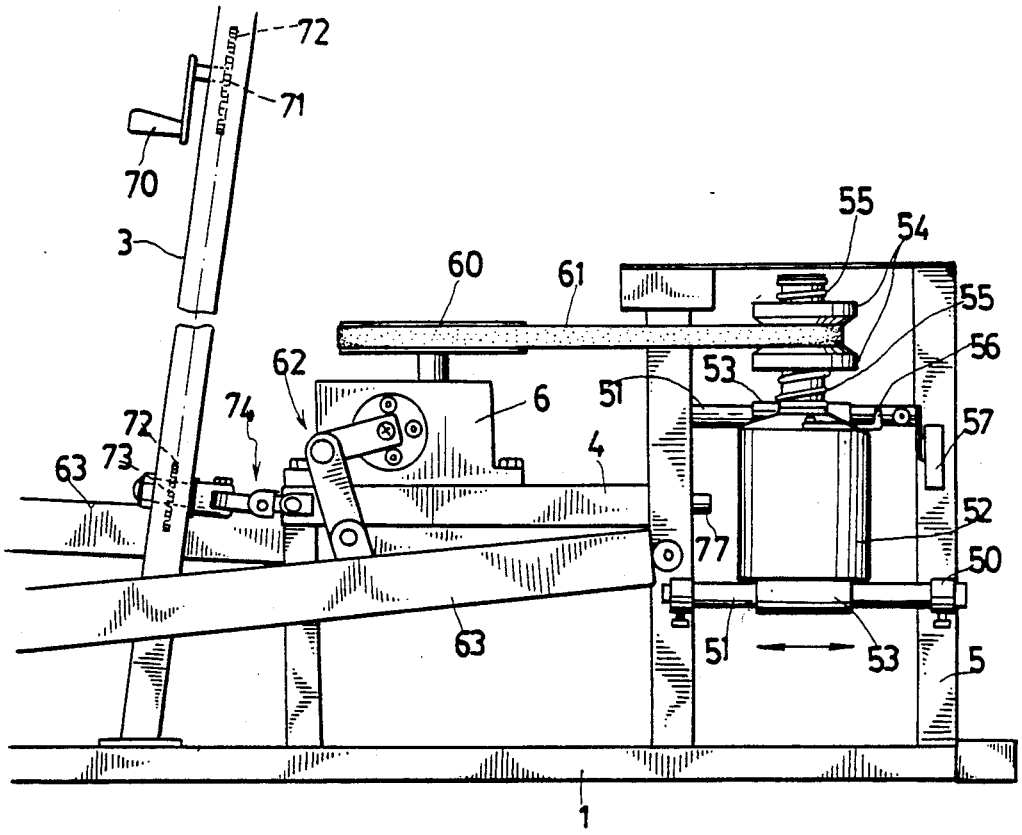
FIG. 2 is a fragmentary view of the stairclimber with a safety speed changing device.
Figure 3:
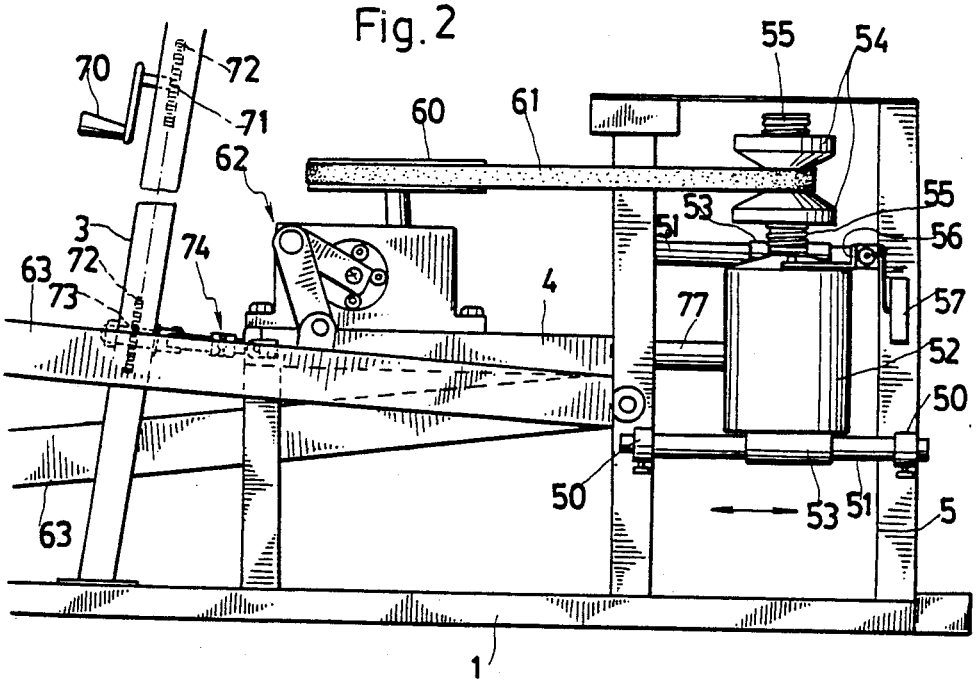
FIG. 3 shows the principle of the stairclimber with a safety speed changing device.
Figure 4A:
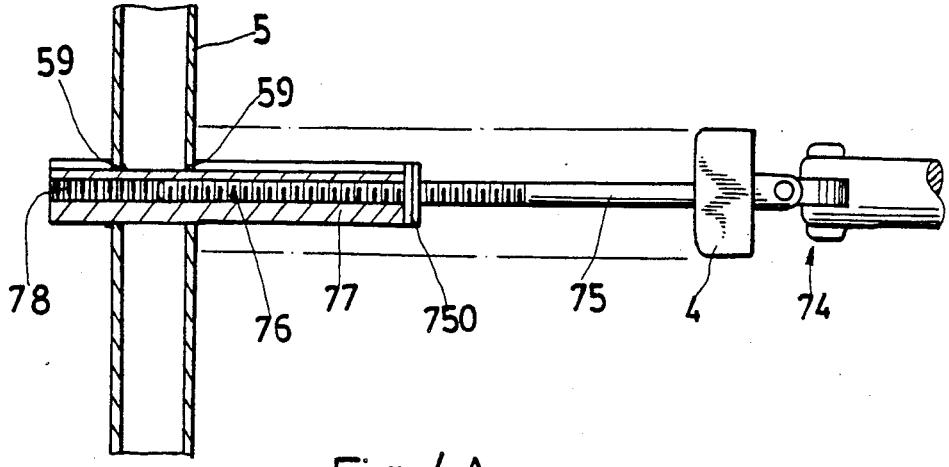
FIG. 4A, 4B and 4C a show how the universal joint moves the sleeve outwards via a screw.
Figure 4B:
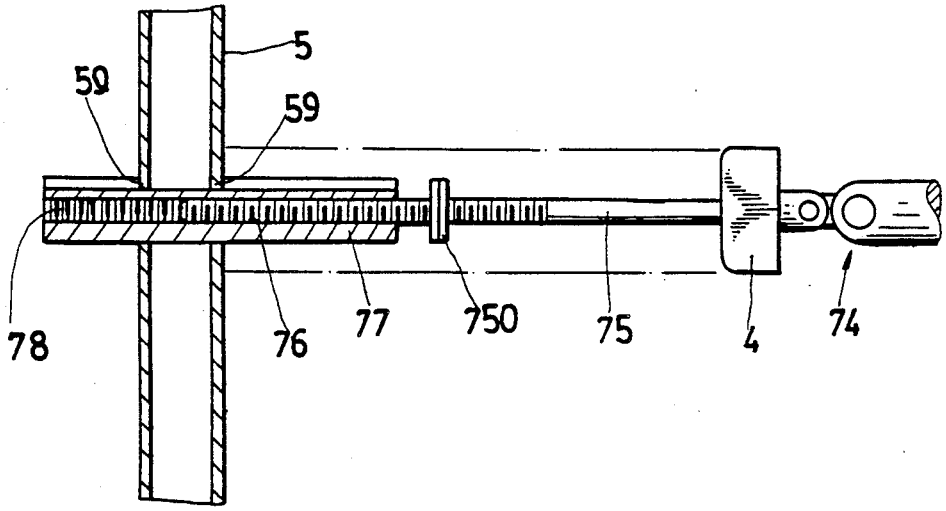
Figure 4C:
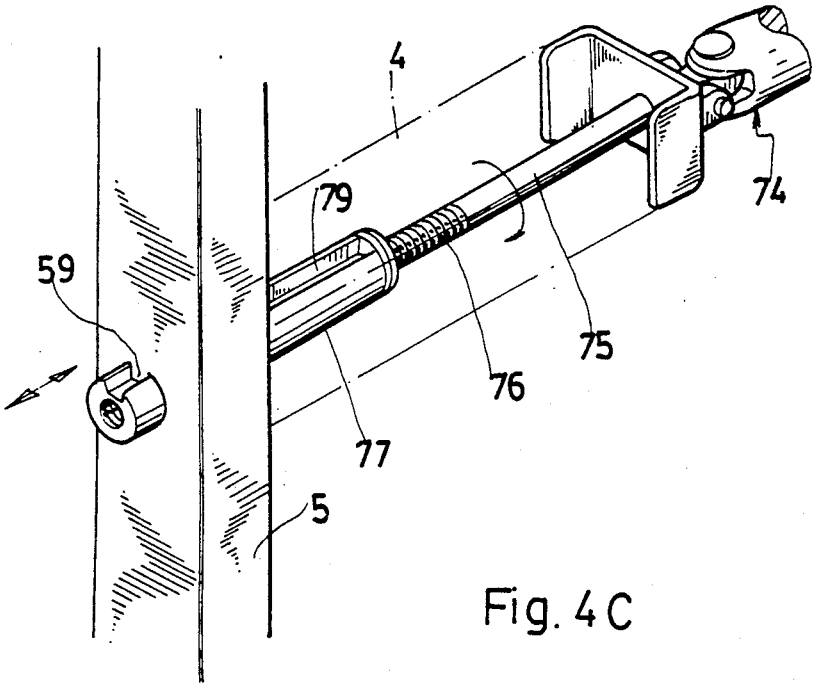
Figure 5:
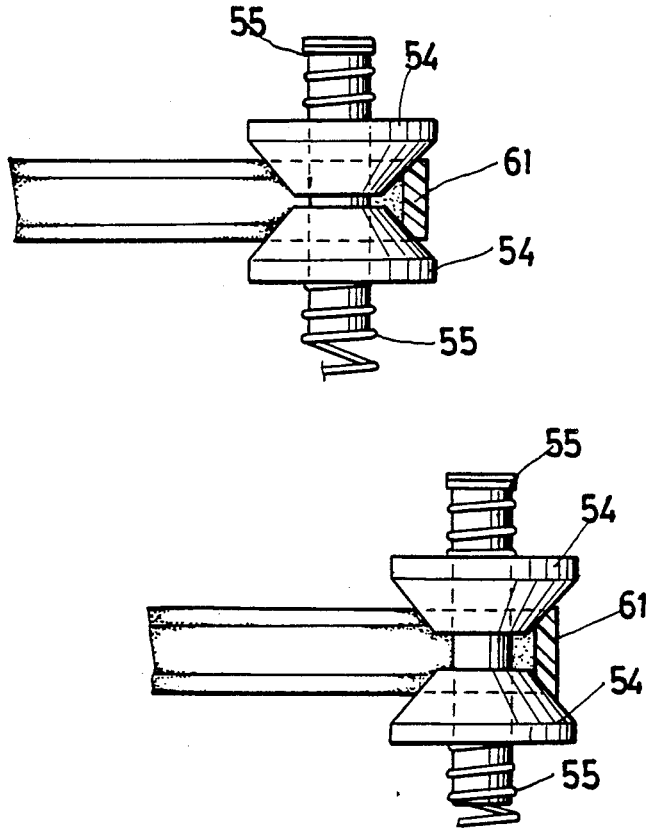
FIG. 5A and 5B show the belt in tension.

With reference to the drawings and in particular to FIG. 1 thereof, the stairclimber according to the present invention mainly comprises a base 1, a handle frame 2, a support 3, a front bracket 4, a rear bracket 5, a transmission mechanism 6 and a speed changing mechanism 7.

The handle frame 2 is vertically mounted on the base and has a gauge board 20 on the top. The support 3 is vertically mounted between the gauge board 20 and the base 1. The front bracket 4 is also fixed on the base 1 and spaced apart from the support 3. The rear bracket 5 is mounted on the base 1 and disposed in front of the front bracket 4.

The rear bracket 5 is provided with two guide rods 51 engaged with a sleeve 50. The guide rods 51 are connected with a sliding plate 53 on which is mounted on a motor 52. The axle of the motor 52 is pivotally connected with a variable speed V-pulley 54 loaded with a spring 55. Further, there is an actuating strip 56 for controlling a micro-switch 57. The rear bracket 5 is connected at the upper end with the support 3 via a bar 58 and has a hole with a stop member 59 at the position engaged with the vertical rod of the front bracket 4.

The transmission mechanism 6 is fixedly mounted on the upper side of the front bracket 4, which is well known in the art and has no need to be described here in detail. The transmission mechanism 6 is provided with a pulley 60 connected to a rotating disc 54 of a motor 52 via a belt 61. A link 62 is pivotally connected with an oscillating rod 63 having a pair of pedals 64. The rear end of the oscillating rod 63 is in turn pivoted on two sides of the rear bracket 5.

The speed changing mechanism 7 utilizes a rotating handle 70 disposed on the upper half of the support 3 to control an upper gear 71 in the support 3. The upper gear 71 in turn drives the lower gear 73 via a chain 72. The lower gear 73 is mounted on the center of the universal joint 74 which is in turn connected to an axle 75 provided with male threads 76 and a stop collar 750 at the end so that the axle 75 may be engaged with a sleeve 77 with female threads 78. The sleeve 77 is further formed at the top with a groove 79 adapted to receive the stop member 59.

In use, first turn the rotating handle 70 to drive the upper gear 71 which will drives the lower gear 73 via the chain 72, thereby causing the lower gear 73 to rotate the universal joint 74. As the universal joint 74 is rotated, the axle 75 will be rotated therewith. Further, since the male threads 76 on the other end of the axle 75 is engaged with the female threads 78 of the sleeve 77 and the groove 79 of the sleeve 77 is adapted to the stop member 59 of the rear bracket 5, the sleeve 77 will move to and fro, i.e. reverse turning of the rotating handle 70 will control the sleeve 77 to move to and fro. When the sleeve 77 moves backwards, the motor 52 will be moved backwards along the guide rod 51 via the sliding plate 53, thus tensioning the belt 61 and urging the pulleys 54 to force the springs 55 outwards. Therefore, the rotating radius of the belt 61 driven by motor 52 is decreased. In addition, as the sleeve 77 retracts forward, the motor 52 will certainly return to its original position by the resilient force of the belt 61. Meanwhile, the pulleys 54 will also be return to their original positions by the springs 55 thereby enlarging the rotating radius of the belt 61 driven by the motor 52. Since the circumference of the pulley 60 is of a fixed value, the belt 61 driven by the motor 52 is enlarged in rotating radius and the pulley 60 will rotate faster. Hence, the pulley 60 will drive the oscillating rod 63 via the transmission mechanism 6 and the links 62 to move up and down, thereby exercising the legs of the user.

As the user controls the rotating handle 70 to move the motor 52 backwards gradually, the actuating plate 56 of the motor 52 will trigger the switch 57 on the rear frame 5 transmitting a triggering signal into the controlling circuit which is well known in the art and has no need to be described. When desired to use the input power source next time, the motor will be controlled not to move and it is necessary to use the rotating handle 70 to push the actuating plate 56 of the motor 52 to trigger the switch 57 in order to rotate the motor 52. At that time, since the motor 52 is located at such a position where the rotating radius of the belt 61 driven by the rotating disc 54 is the smallest and the speed is slowest. In short, the oscillating speed must be adjusted from the slowest to the fastest therefore increasing safety.

Although the present invention has been described with a certain degree of particularity, it is understood that the present disclosure is made by way of example only and that numerous changes in the construction and the arrangement and combination of parts may be resorted to without departing from the spirit and scope of the invention as hereinafter claimed.

I claim:

1. A stairclimber with a safety speed changing device comprising:

a base;

a handle frame vertically mounted on said base;

a support vertically mounted between a gauge board and said base;

a front bracket fixed on said base and spaced apart from said support;

a rear bracket mounted on said base and disposed rearwardly of said front bracket;

a motor having a variable speed V-pulley and slideably mounted on said rear bracket;

a transmission mechanism fixedly mounted on the upper side of said front bracket and provided with a pulley connected to said variable speed V-pulley of said motor via a belt, and a linkage pivotally connected with an oscillating rod having a pair of pedals, said oscillating rod having a rear end which is in turn pivoted on two sides of said rear bracket; and a speed changing mechanism having a rotating handle disposed on upper half of said support to control an upper gear which in turn drives a lower gear via a chain, said lower gear connected to a universal joint connected with an axle having male threads and a stop collar at the end so that the axle may be engaged with a sleeve with female threads, said sleeve being formed at the top with a groove adapted to receive a stop member on the rear bracket, whereby said sleeve is moved rearwardly to push said motor and thereby change the exercising speed via the variable speed V-pulley.

* * * * *